US010328355B2

(12) United States Patent
Rosen et al.

(10) Patent No.: US 10,328,355 B2
(45) Date of Patent: Jun. 25, 2019

(54) CONNECTOR FOR MAGNETIC MODULES AND TOY CONSTRUCTION KITS EMPLOYING SAME

(71) Applicant: LaRose Industries, LLC, Randolph, NJ (US)

(72) Inventors: Lawrence Rosen, Mendham, NJ (US); Parviz Daftari, Summit, NJ (US)

(73) Assignee: LAROSE INDUSTRIES, LLC, Randolph, NJ (US)

( * ) Notice: Subject to any disclaimer, the term of this patent is extended or adjusted under 35 U.S.C. 154(b) by 0 days.

(21) Appl. No.: 15/863,590

(22) Filed: Jan. 5, 2018

(65) Prior Publication Data

US 2018/0126294 A1 May 10, 2018

Related U.S. Application Data

(63) Continuation-in-part of application No. 15/427,972, filed on Feb. 8, 2017, now Pat. No. 10,080,977.

(60) Provisional application No. 62/442,828, filed on Jan. 5, 2017, provisional application No. 62/293,938, filed on Feb. 11, 2016.

(51) Int. Cl.

| | |
|---|---|
| ***A63H 33/04*** | (2006.01) |
| ***A63H 33/08*** | (2006.01) |
| ***A63H 33/10*** | (2006.01) |

(52) U.S. Cl.

CPC ..... *A63H 33/046* (2013.01); *A63H 33/04* (2013.01); *A63H 33/086* (2013.01); *A63H 33/10* (2013.01); *A63H 33/107* (2013.01); *A63H 33/108* (2013.01)

(58) Field of Classification Search

CPC ..... A63H 33/04; A63H 33/046; A63H 33/08; A63H 33/086; A63H 33/10; A63H 33/101; A63H 33/107; A63H 33/108

See application file for complete search history.

(56) References Cited

U.S. PATENT DOCUMENTS

| | | | | |
|---|---|---|---|---|
| 2,970,388 A * | 2/1961 | Yonkers | ..... | A63H 33/046 403/171 |
| 3,195,266 A | 7/1965 | Onanian | | |
| 3,564,758 A | 2/1971 | Willis | | |

(Continued)

FOREIGN PATENT DOCUMENTS

| | | |
|---|---|---|
| EP | 2590183 | 5/2013 |
| JP | H0780156 A | 3/1995 |

(Continued)

OTHER PUBLICATIONS

Smartmax General Instructions, Smart—Belgium, Brochure (2003-2015).

(Continued)

*Primary Examiner* — Eugene L Kim
*Assistant Examiner* — Alyssa M Hylinski
(74) *Attorney, Agent, or Firm* — Greenberg Traurig, LLP

(57) ABSTRACT

The present disclosure relates to toy construction kits and assemblies and, more particularly, to connectors that are mechanically attached to and extend from the corners of geometric frame-like modules. The connectors are also adapted to interface with and magnetically connect to linear magnetic modules, whereby a user can create multiple construction platforms upon which a number of diverse and interesting structures can be assembled.

14 Claims, 12 Drawing Sheets

(56) References Cited

U.S. PATENT DOCUMENTS

| | | | | |
|---|---|---|---|---|
| 3,604,145 | A | 9/1971 | Zimmerman | |
| 3,991,511 | A | 11/1976 | McAllister | |
| 5,575,701 | A * | 11/1996 | Hantman | A63H 33/10 446/104 |
| 5,683,283 | A | 11/1997 | Glynn | |
| 5,788,555 | A | 8/1998 | Glynn | |
| 5,823,531 | A | 10/1998 | Huber | |
| 5,938,498 | A | 8/1999 | Glynn | |
| 6,626,727 | B2 * | 9/2003 | Balanchi | A63H 33/046 273/157 R |
| 7,154,363 | B2 * | 12/2006 | Hunts | H01F 7/0242 335/306 |
| 7,666,054 | B2 * | 2/2010 | Glickman | A63H 33/082 446/120 |
| 7,758,398 | B2 | 7/2010 | Park | |
| 8,016,636 | B2 | 9/2011 | Park | |
| 8,458,863 | B2 | 6/2013 | Hunts | |
| 8,911,276 | B2 * | 12/2014 | Kim | A63H 33/046 446/92 |
| 9,022,829 | B2 * | 5/2015 | Rosen | A63H 33/046 446/108 |
| 9,669,324 | B2 * | 6/2017 | Roth | A63H 33/062 |
| 10,080,977 | B2 * | 9/2018 | Rosen | A63H 33/046 |
| 2003/0007829 | A1 * | 1/2003 | Huang | A63H 33/04 403/171 |
| 2005/0124259 | A1 * | 6/2005 | Tusacciu | A63H 33/046 446/129 |
| 2006/0014467 | A1 * | 1/2006 | Tusacciu | A63H 33/046 446/126 |
| 2006/0178081 | A1 * | 8/2006 | Daftari | A63H 3/46 446/92 |
| 2012/0131878 | A1 | 5/2012 | Ivanov | |
| 2013/0111710 | A1 | 5/2013 | Hunts | |
| 2013/0165012 | A1 * | 6/2013 | Klauber | A63H 33/062 446/91 |
| 2015/0258461 | A1 * | 9/2015 | Balanchi | A63H 33/046 446/92 |
| 2016/0074766 | A1 | 3/2016 | Choi | |

FOREIGN PATENT DOCUMENTS

| | | | |
|---|---|---|---|
| JP | 2002-159761 | | 6/2002 |
| JP | 2003-190663 | | 7/2003 |
| KR | 100720691 | B1 | 5/2007 |
| KR | 101684922 | B1 | 12/2016 |
| WO | 2006044613 | | 4/2006 |
| WO | 2006057471 | A1 | 6/2006 |

OTHER PUBLICATIONS

International Search Report and Written Opinion for International (PCT) Application No. PCT/US2018/012667, dated Jun. 20, 2018.

* cited by examiner

CONNECTOR FOR MAGNETIC MODULES AND TOY CONSTRUCTION KITS EMPLOYING SAME

CROSS-REFERENCE TO RELATED APPLICATIONS

The present application claims the benefit of U.S. Provisional Patent Application No. 62/442,828, filed on Jan. 5, 2017, which is incorporated by reference herein in its entirety. The present application is also a continuation-in-part and claims the benefit of U.S. Non-Provisional application Ser. No. 15/427,972, filed on Feb. 8, 2017, now U.S. Pat. No. 10,080,977, which application is incorporated by reference herein in its entirety along with related U.S. Patent Publication No. 2017/0232357A1, dated Aug. 17, 2017, and which claims the benefit of U.S. Provisional Application No. 62/293,938, filed on Feb. 11, 2016, which is incorporated by reference herein in its entirety.

FIELD OF INVENTION

The following disclosure relates to toy construction modules and connectors for connecting magnetic and/or non-magnetic modules to each other, and, more particularly, to magnetic modules and connectors that may be used with other similar and/or dissimilar modules and connectors in a toy construction kit for building structures.

BACKGROUND OF THE INVENTION

Magnetic construction kits have become a popular category for children's toys. These kits ordinarily include construction modules having magnets embedded therein that enable the modules to be connected together via magnetism. Using these modules, children are able to assemble many imaginative two-dimensional and three-dimensional shapes and structures, thereby imparting great enjoyment and entertainment to the children using them.

SUMMARY OF THE INVENTION

In view of the foregoing background, the present invention can be summarized as a mechanism for interconnecting magnetic and/or non-magnetic modules of a toy construction set or kit, which may include a plurality of geometric frames and a plurality of connectors adapted so as to be fixedly, but removably, received in the corners of the geometric frames. The connectors are also adapted to interface with linear magnetic modules, thereby allowing a user to create multiple construction platforms upon which a number of diverse and interesting structures can be built.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION OF THE EXEMPLARY EMBODIMENTS

Figure 1A:
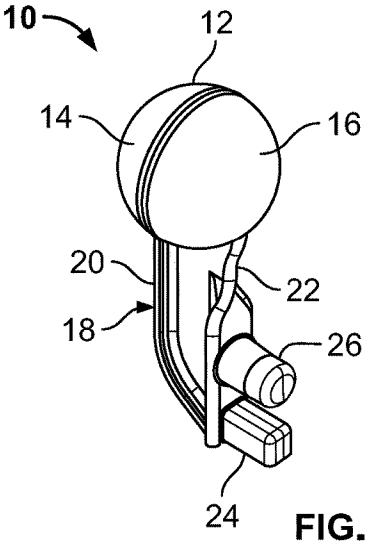
FIG. 1A is a perspective view of a connector according to an embodiment of the present invention, one for use with triangular frame-like modules.
Figure 1B:
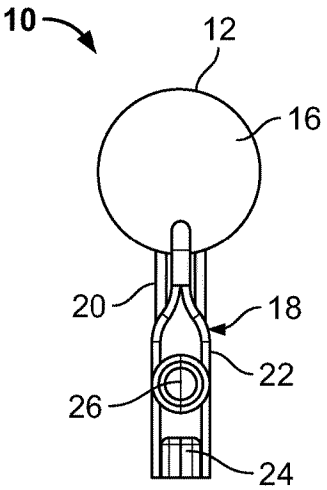
FIG. 1B is a front elevational view of the connector shown in FIG. 1A.
Figure 1C:
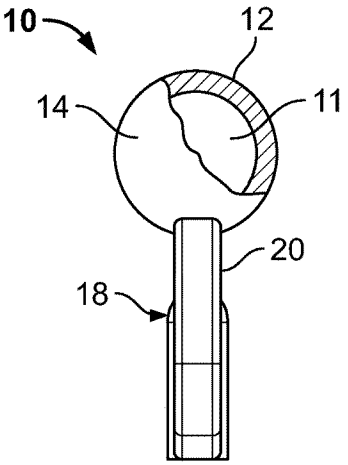
FIG. 1C is a rear elevational view of the connector shown in FIG. 1A, a portion of the connector being represented by a broken-out section to facilitate consideration and discussion of an internal element of the illustrated connector.
Figure 1D:
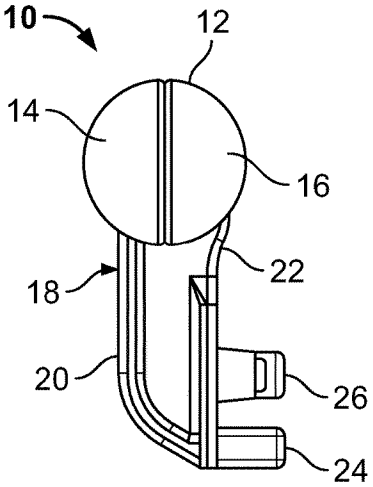
FIG. 1D is a side elevational view of the connector shown in FIG. 1A.
Figure 2B:
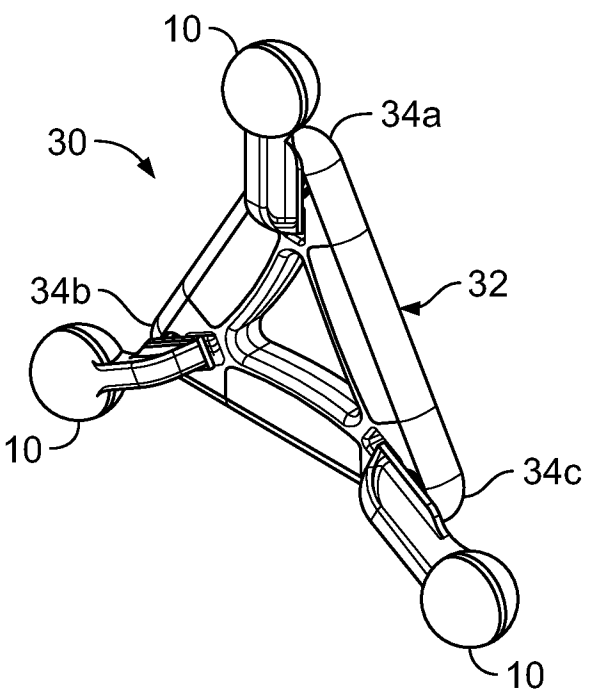
FIG. 2B is a rear perspective view of the module/connector assembly shown in FIG. 2A.
Figure 2A:
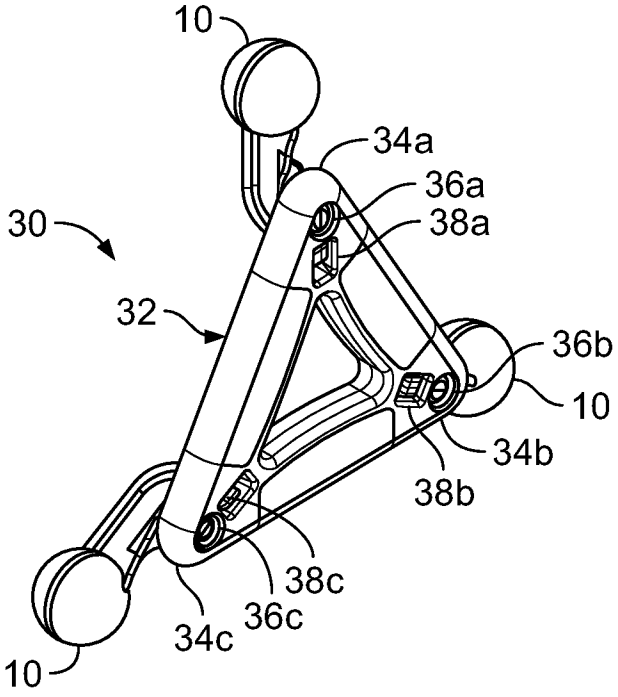
FIG. 2A is a front perspective view of a triangular frame-like toy construction module equipped with three of the connectors shown in FIGS. 1A-1D, one in each corner of the module in accordance with an embodiment of the present invention.
Figure 2E:
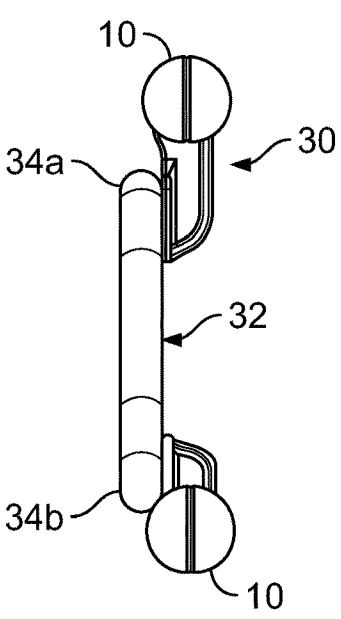
FIG. 2E is a side elevational view of the module/connector assembly shown in FIG. 2A.
Figure 2D:
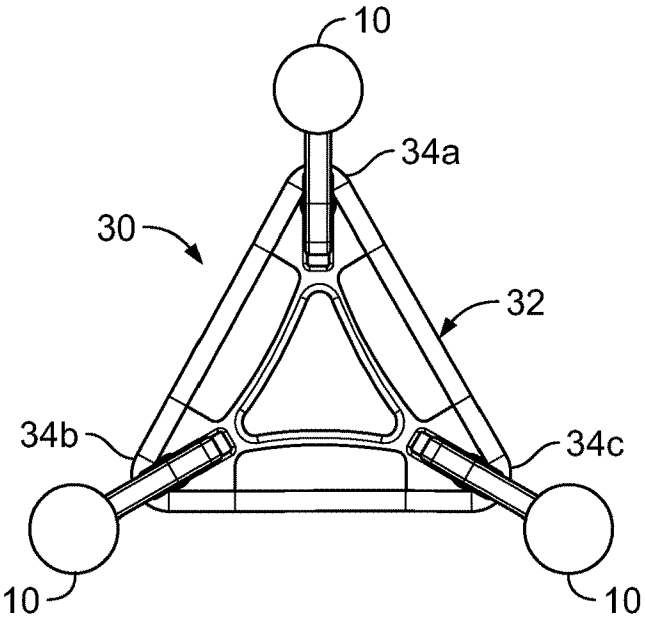
FIG. 2D is a rear elevational view of the module/connector assembly shown in FIG. 2A.
Figure 2C:
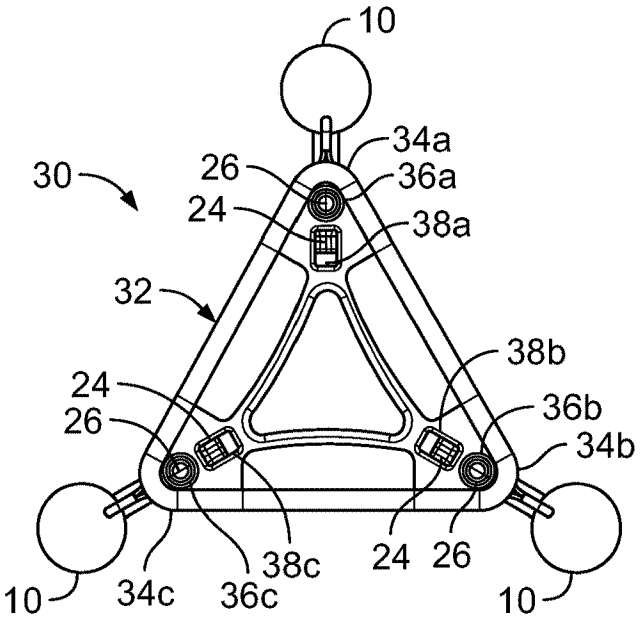
FIG. 2C is a front elevational view of the module/connector assembly shown in FIG. 2A.

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign thereto. Further, it should be noted that, as recited herein, the singular forms "a", "an", and "the" include the plural referents unless otherwise stated. Additionally, the terms "comprises" and "comprising" when used herein specify that certain features are present in that embodiment. However, this phrase should not be interpreted to preclude the presence of additional steps, operations, features, components, and/or groups thereof.

FIGS. 1A-1D are illustrations of a connector 10 for triangular frames, such as the frame 112*a* disclosed in the U.S. Patent Application Publication No. 2017/0232357A1 (see, for example, FIG. 6), the entire disclosure of which is incorporated herein by reference. In an embodiment, the connector 10 includes a ball 11 (see FIG. 1C) that is attracted by magnets. In an embodiment, the ball 11 is made of steel. In an embodiment, the ball 11 is spherical. In an embodiment, the ball 11 has a shape other than a sphere. In an embodiment, the ball 11 is housed in an enclosure 12, which may have a first enclosure part 14 and a second enclosure part 16 that are joined together so as to enclose the ball 11. In an embodiment, the first enclosure part 14 and the second enclosure part 16 are made from non-magnetic plastic material joined together by, for instance, ultrasonic welding.

In an embodiment, the connector 10 has an arm 18 which is joined to or continuous with the enclosure 12. In an embodiment, the arm 18 is a single piece. In an embodiment, the arm 18 has a first arm piece 20 joined to the first enclosure part 14 and a second arm piece 22 joined to the second enclosure part 16. In an embodiment, the first arm piece 20 and the second arm piece 22 are joined together. In an embodiment, the first arm piece 20 and the second arm piece 22 are made from a non-magnetic plastic material joined together by, for instance, ultrasonic welding.

In an embodiment, the arm 18 has an inner post 24, which has a rectangular cross-sectional shape as well as a function and purpose to be described hereinafter. In an embodiment, the arm 18 has an outer post 26, which has a circular or round cross-sectional shape as well as a function and purpose to be described hereinafter. In an embodiment, the inner post 24 and the outer post 26 project in the same direction (i.e., generally laterally relative to the arm 18, while the ball 11 and its enclosure 12 extend in a generally longitudinal direction relative to the arm 18). In an embodiment, the inner post 24 and the outer post 26 project from the second arm piece 22.

FIGS. 2A-2E are illustrations of an assembly 30 which includes a triangular frame 32 having the connector 10 of FIGS. 1A-1D installed at each of its three corners 34*a*, 34*b*, 34*c*, each of which includes a circular aperture 36*a*, 36*b*, 36*c*, respectively, and a rectangular notch 38*a*, 38*b*, 38*c*, respectively, positioned between the outer and inner peripheral edges of the corners 34*a*, 34*b*, 34*c*, respectively. In an embodiment, the triangular frame 32 may be of a type similar to triangular frame 112*a* disclosed in U.S. Patent Application Publication No. 2017/0232357A1 (see FIG. 6). It may be noted that the triangular frame 112*a* disclosed in the aforesaid patent application publication includes magnets, cavities for the magnets, and enclosures for the magnets.

The triangular frame(s) 32 for use with the connector 10 of the present invention may be provided with such magnets, cavities, and enclosures, or they may be provided without such magnets, cavities, and enclosures. The triangular frame(s) 32 for use with the connector 10 of the present invention may include other features disclosed in U.S. Patent Application Publication No. 2017/0232357A1. For example, and with particular reference to FIGS. 2A and 2C of the present application, the corners 34*a*-34*c* of the triangular frame 32 can be rendered frangible, or more frangible, by, for instance, providing the corners 34*a*-34*c* with the aperture and notch combinations disclosed in the aforesaid patent application publication. In the assembly 30, the inner post 24 and outer post 26 of the connector 10 (see especially FIGS. 1A, 1B and 1D; but also FIG. 2C) are adapted (i.e., sized and shaped) to be fixedly, but releasably, received in the apertures 36*a*-36*c* and the notches 38*a*-38*c*, respectively, of the triangular frame 32, whereby each of its corners 34*a*-34*c* can be removably equipped with a corresponding one of the connectors 10 via a mechanical connection.

FIGS. 3A-3E are illustrations of an assembly 40 which includes the triangular frame 32 and connectors 10 of FIGS. 2A-2E in combination with three linear magnetic modules 42*a*, 42*b*, 42*c*. Each of the linear magnetic modules 42*a*-42*c* includes an electrically non-conductive body 44 with a first end 46 and a second end 48 opposite the first end 46. A first magnet (not shown) is fixedly positioned at or within the first end 46 and a second magnet (not shown) is fixedly positioned at or within the second end 48. The linear magnetic modules 42*a*-42*c* are held in position by magnetic attraction between the magnets in the linear magnetic modules 42*a*-42*c* and the balls 11 (see FIG. 1C) of the abutting connectors 10.

Figure 3B:
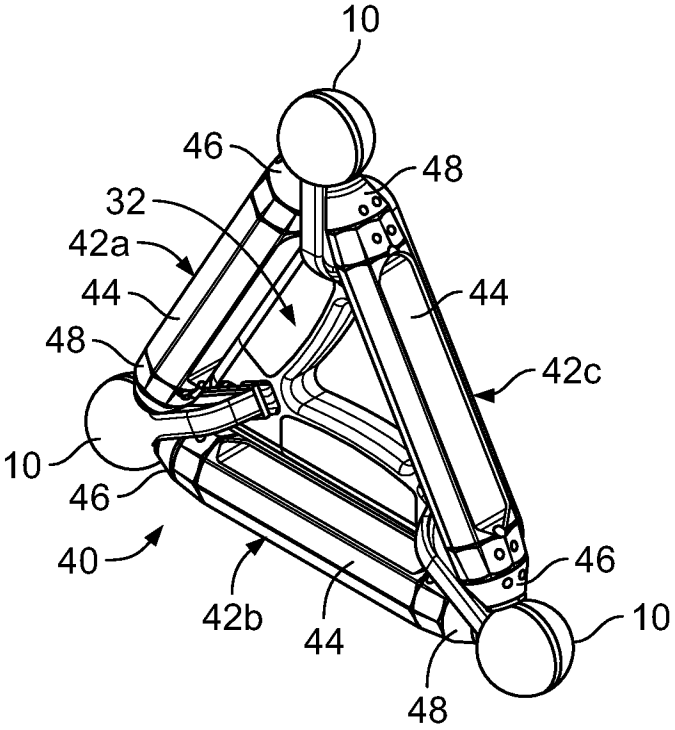
FIG. 3B is a rear perspective view of the combination shown in FIG. 3A.
Figure 3A:
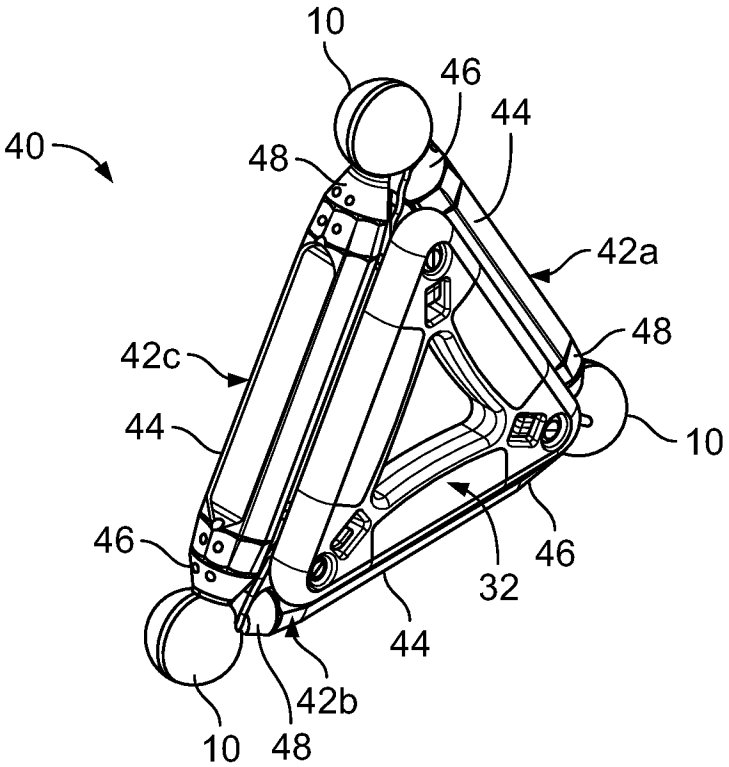
FIG. 3A is a front perspective view of the module/connector assembly of FIGS. 2A-2E shown in combination with three linear magnetic modules.
Figure 3D:
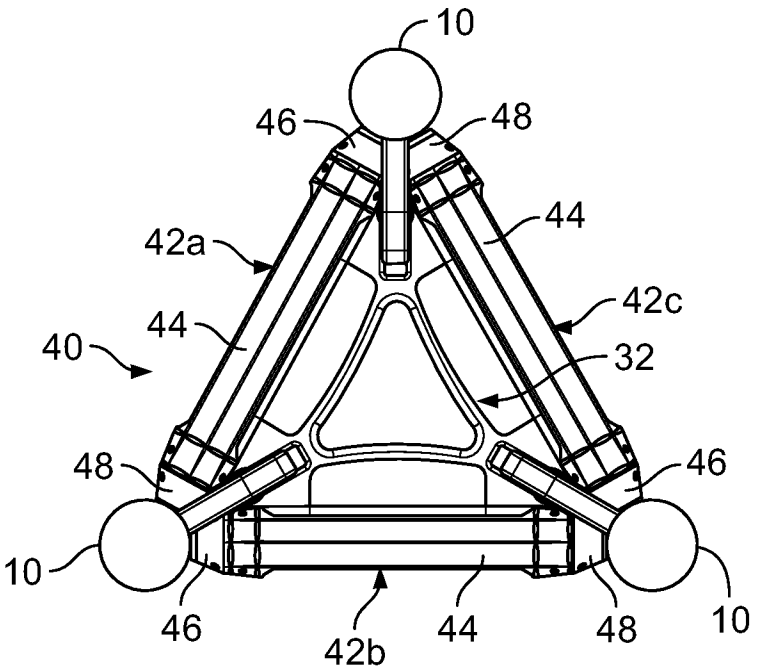
FIG. 3D is a rear elevational view of the combination shown in FIG. 3A.
Figure 3C:
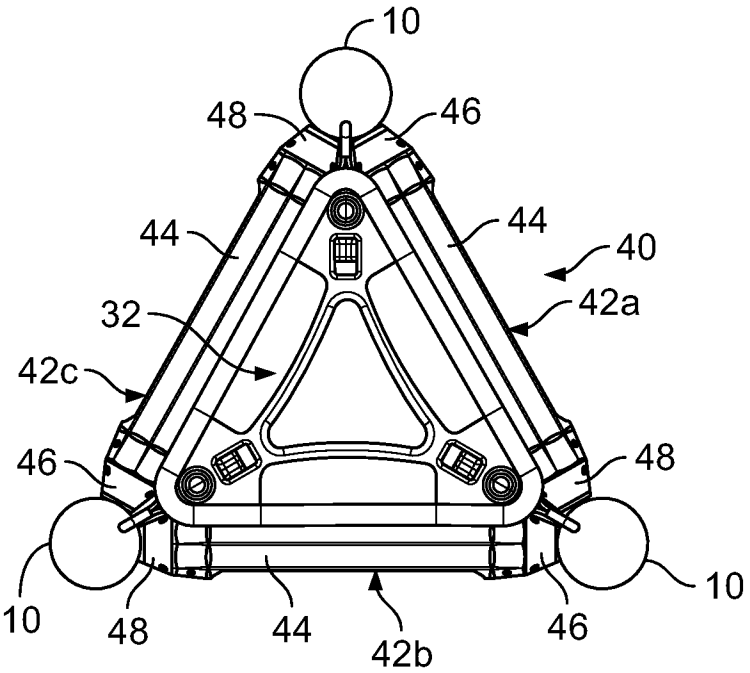
FIG. 3C is a front elevational view of the combination shown in FIG. 3A.
Figure 3E:
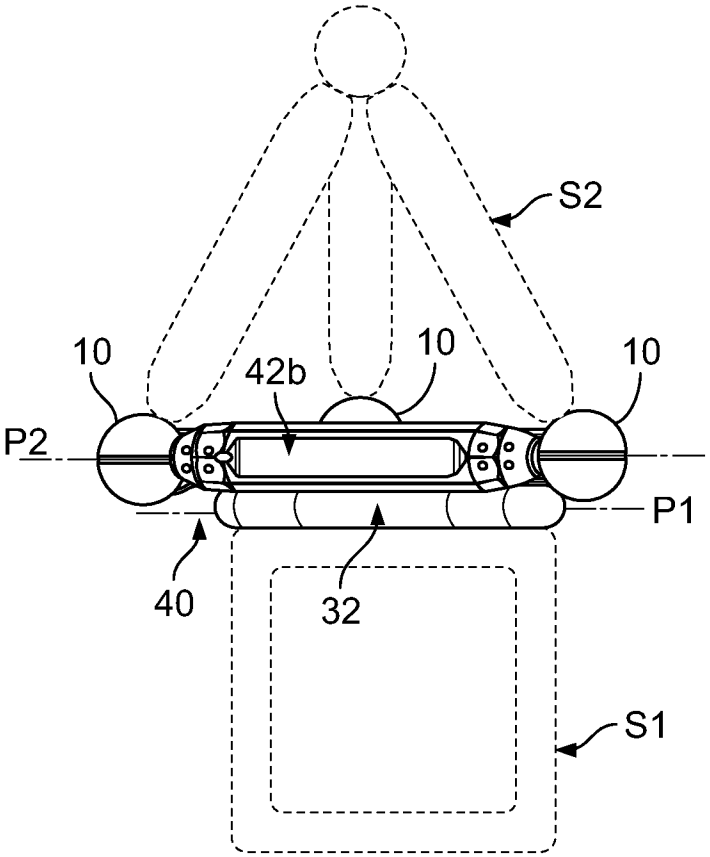
FIG. 3E is a side elevational view of the combination shown in FIG. 3A with optional building components being illustrated schematically and in phantom.
Figure 4B:
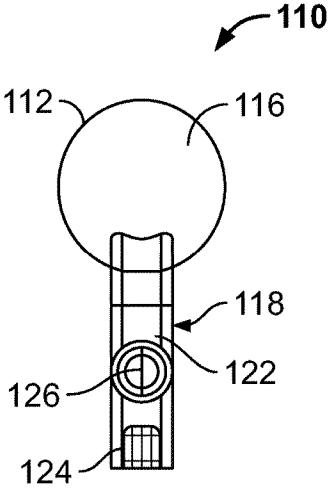
FIG. 4B is a front elevational view of the connector shown in FIG. 4A.
Figure 4D:
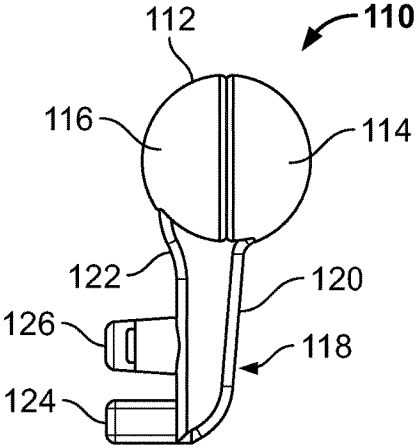
FIG. 4D is a side elevational view of the connector shown in FIG. 4A.
Figure 4C:
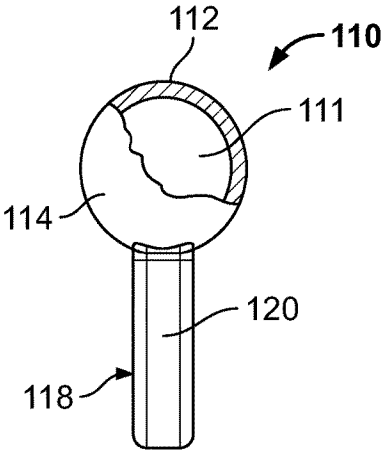
FIG. 4C is a rear elevational view of the connector shown in FIG. 4A, a portion of the connector being represented by a broken-out section to facilitate consideration and discussion of an internal element of the illustrated connector.
Figure 4A:
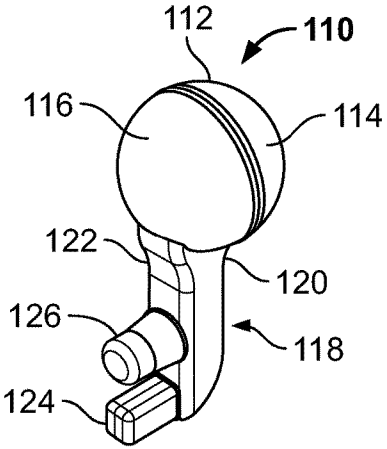
FIG. 4A is a perspective view of a connector according to an embodiment of the present invention, one for use with square frame-like modules.
Figure 5B:
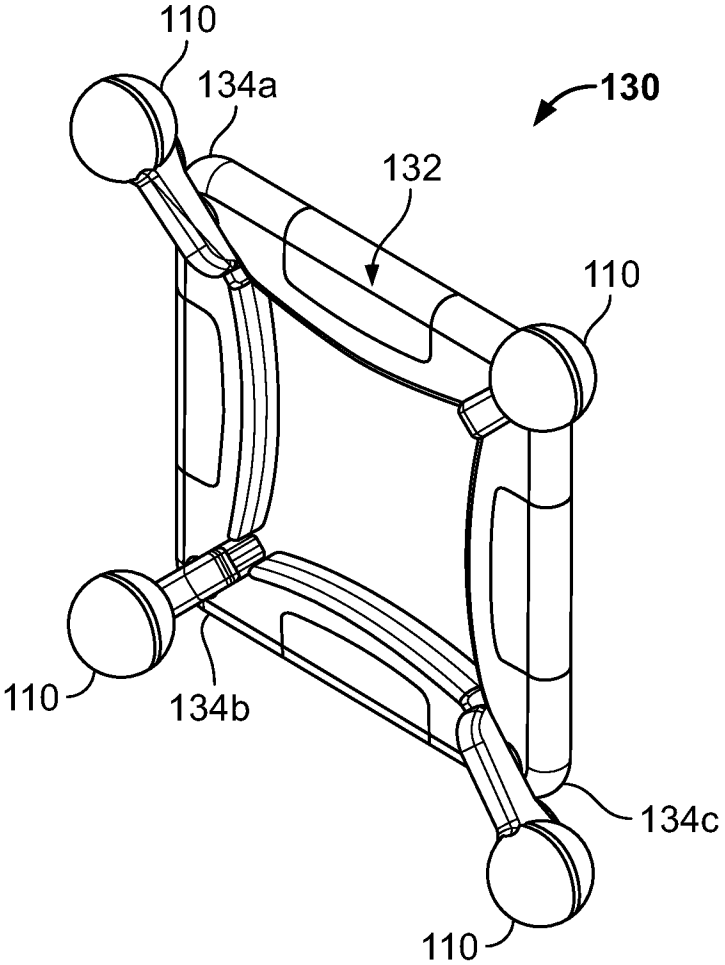
FIG. 5B is a rear perspective view of the module/connector assembly shown in FIG. 5A.
Figure 5A:
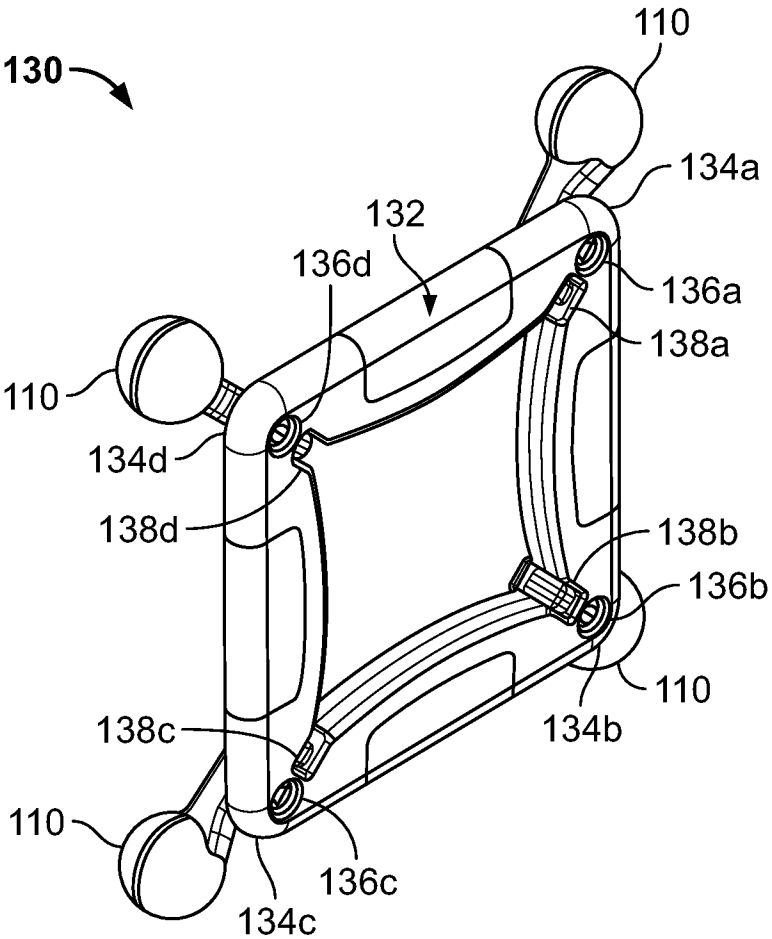
FIG. 5A is a front perspective view of a square frame-like toy construction module equipped with four of the connectors shown in FIGS. 4A-4D, one in each corner of the module in accordance with an embodiment of the present invention.
Figures 5C, 5D, 5E:
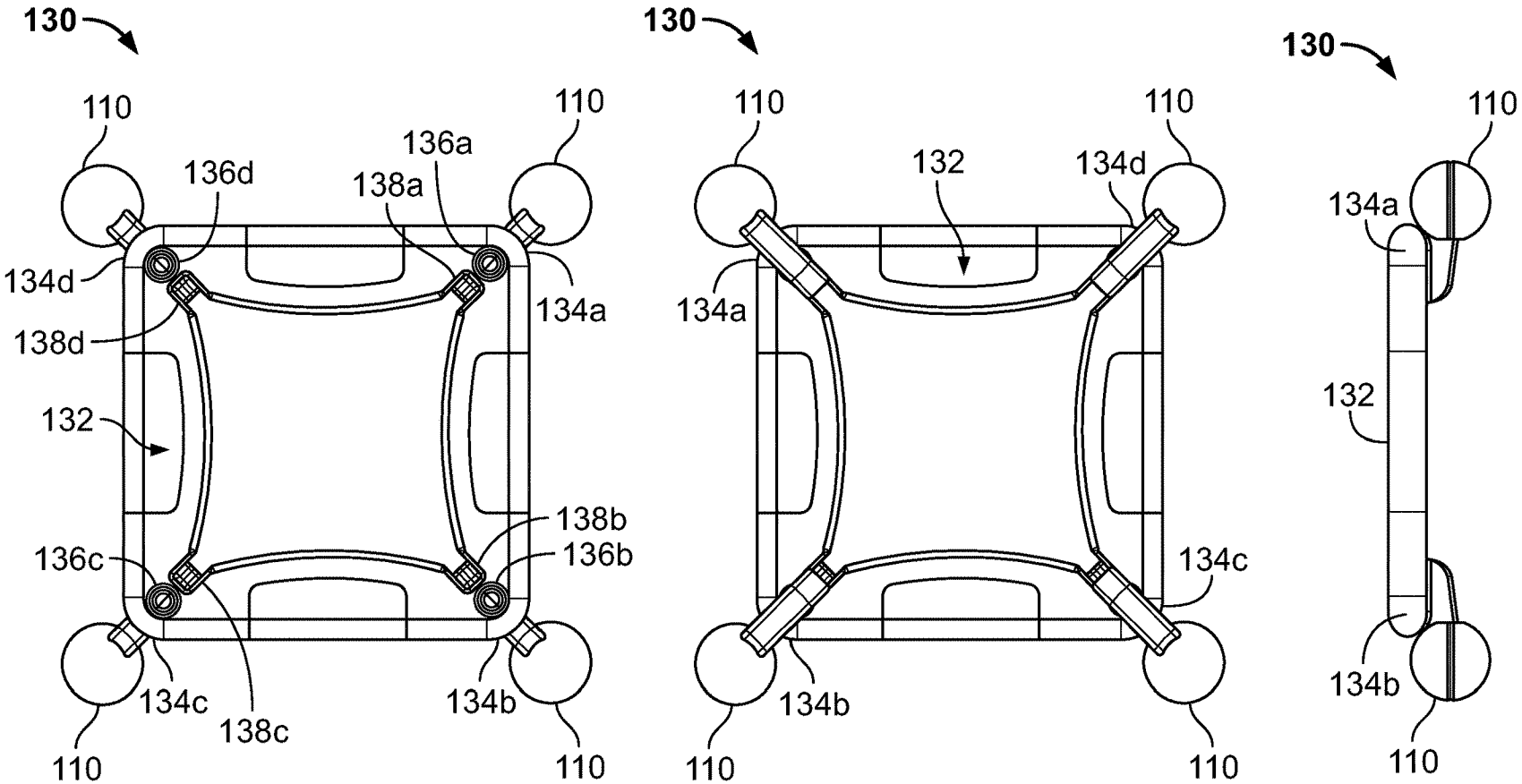
FIG. 5C is a front elevational view of the module/connector assembly shown in FIG. 5A.
FIG. 5D is a rear elevational view of the module/connector assembly shown in FIG. 5A.
FIG. 5E is a side elevational view of the module/connector assembly shown in FIG. 5A.

With reference to the assembly 40 illustrated in FIG. 3E, the triangular frame 32 constitutes a first construction platform, which lies in a plane P1 defined by the triangular frame 32. Conversely, the connectors 10 cooperate with each other and with the magnetic modules 42*a*-42*c* to define a plane P2 and to form a second construction platform. Referring still to FIG. 3E, the plane P2 is substantially parallel to, but offset from, the plane P1. By providing two construction platforms, the assembly 40 permits a user to build a first subassembly S1 (shown in phantom) off of the first construction platform (i.e., the triangular frame 32) and a second subassembly S2 (shown in phantom) off of the second construction platform (i.e., the connectors 10 and the magnetic modules 42*a*-42*c*).

By way of example only, and with continued reference to FIG. 3E, other similar or different types of frame-like building elements can be removably connected or attached to the triangular frame 32 (see, for instance, the square frame-like magnetic module shown in phantom in FIG. 3E as subassembly S1), while other similar or different types of magnetic modules can be removably connected or attached to the connectors 10 (see, for instance, the linear magnetic modules and steel ball shown in phantom in FIG. 3E as subassembly S2). In general, but especially when the balls 11 and enclosures 12 have the spherical, or similar, shape illustrated in, for instance, FIG. 3E, the linear magnetic modules shown in phantom in FIG. 3E can be arranged, or rearranged, at various different angles and orientations relative to the connector 10 that they are magnetically attached to. The assembly 40 illustrated in FIGS. 3A-3E therefore provides multiple platforms upon which a number of diverse and interesting structures can be built.

FIGS. 4A-4D are illustrations of a connector 110 for square frames, such as the frame 12*a* disclosed in U.S. Patent Application Publication No. 2017/0232357A1 (see, for example, FIG. 3). In an embodiment, the connector 110 includes a ball 111 (see FIG. 4C) that is attracted by magnets. In an embodiment, the ball 111 is made of steel. In an embodiment, the ball 111 is spherical. In an embodiment, the ball 111 has a shape other than a sphere. In an embodiment, the ball 111 is housed in an enclosure 112, which may have a first enclosure part 114 and a second enclosure part 116 that are joined together so as to enclose the ball 111. In an embodiment, the first enclosure part 114 and the second enclosure part 116 are joined together by ultrasonic welding.

In an embodiment, the connector 110 has an arm 118 which is joined to or continuous with the enclosure 112. In an embodiment, the arm 118 is a single piece. In an embodiment, the arm 118 has a first arm piece 120 joined to the first enclosure part 114 and a second arm piece 122 joined to the second enclosure part 116. In an embodiment, the first arm piece 120 and the second arm piece 122 are joined together. In an embodiment, the first arm piece 120 and the second arm piece 122 are joined together by ultrasonic welding. In an embodiment, the arm 118 of the connector 110 has a different shape, texture, or markings than the arm 18 of the connector 10 so that the connector 110 and the connector 10 can be readily distinguished from each other.

In an embodiment, the arm 118 has an inner post 124, which has a rectangular cross-sectional shape as well as a function and purpose to be described hereinafter. In an embodiment, the arm 118 has an outer post 126, which has a circular or round cross-sectional shape as well as a function and purpose to be described hereinafter. In an embodiment, the inner post 124 and the outer post 126 project in the same direction (i.e., generally laterally relative to the arm 118, while the ball 111 and its enclosure 112 extend in a generally longitudinal direction relative to the arm 118). In an embodiment, the inner post 124 and the outer post 126 project from the second arm piece 122.

FIGS. 5A-5E are illustrations of an assembly 130 which includes a square frame 132 having the connector 110 of FIGS. 4A-4D installed at each of its four corners 134*a*, 134*b*, 134*c*, 134*d*, each of which includes a circular aperture 136*a*, 136*b*, 136*c*, 136*d*, respectively, and a rectangular notch 138*a*, 138*b*, 138*c*, 138*d*, respectively, positioned between the outer and inner peripheral edges of the corners 134*a*, 134*b*, 134*c*, 134*d*, respectively. In an embodiment, the square frame 132 may be of a type similar to square frame 12*a* disclosed in U.S. Patent Application Publication No. 2017/0232357A1 (see FIG. 3). It may be noted that the square frame 12*a* disclosed in the aforesaid patent application publication includes magnets, cavities for the magnets, and enclosures for the magnets. The square frame(s) 132 for use with the connector 110 of the present invention may be provided with such magnets, cavities, and enclosures, or they may be provided without such magnets, cavities, and enclosures.

The square frame(s) 132 for use with the connector 110 of the present invention may include other features disclosed in U.S. Patent Application Publication No. 2017/0232357A1. For example, and with particular reference to FIGS. 5A and 5C of the present application, the corners 134*a*-134*d* of the square frame 132 can be rendered frangible, or more frangible, by, for instance, providing the corners 134*a*-134*d* with the aperture and notch combinations disclosed in the aforesaid patent application publication. In the assembly 130, the inner post 124 and outer post 126 of the connector 110 (see especially FIGS. 4A, 4B and 4D; but also FIG. 5C) are adapted (i.e., sized and shaped) to be fixedly, but releasably, received in the apertures 136*a*-136*d* and the notches 138*a*-138*d*, respectively, of the square frame 132, whereby each of its corners 134*a*-134*d* can be removably equipped with a corresponding one of the connectors 110 via a mechanical connection.

FIGS. 6A-6E are illustrations of an assembly 140 which includes the square frame 132 and connectors 110 of FIGS. 5A-5E in combination with four linear magnetic modules 142*a*, 142*b*, 142*c*, 142*d*. Each of the linear magnetic modules 142*a*-142*d* includes an electrically non-conductive body 144 with a first end 146 and a second end 148 opposite the first end 146. A first magnet (not shown) is fixedly positioned at or within the first end 146 and a second magnet (not shown) is fixedly positioned at or within the second end 148. The linear magnetic modules 142*a*-142*d* are held in position by magnetic attraction between the magnets in the linear magnetic modules 142*a*-142*d* and the balls 111 (see FIG. 4C) of the abutting connectors 110.

Figure 6B:
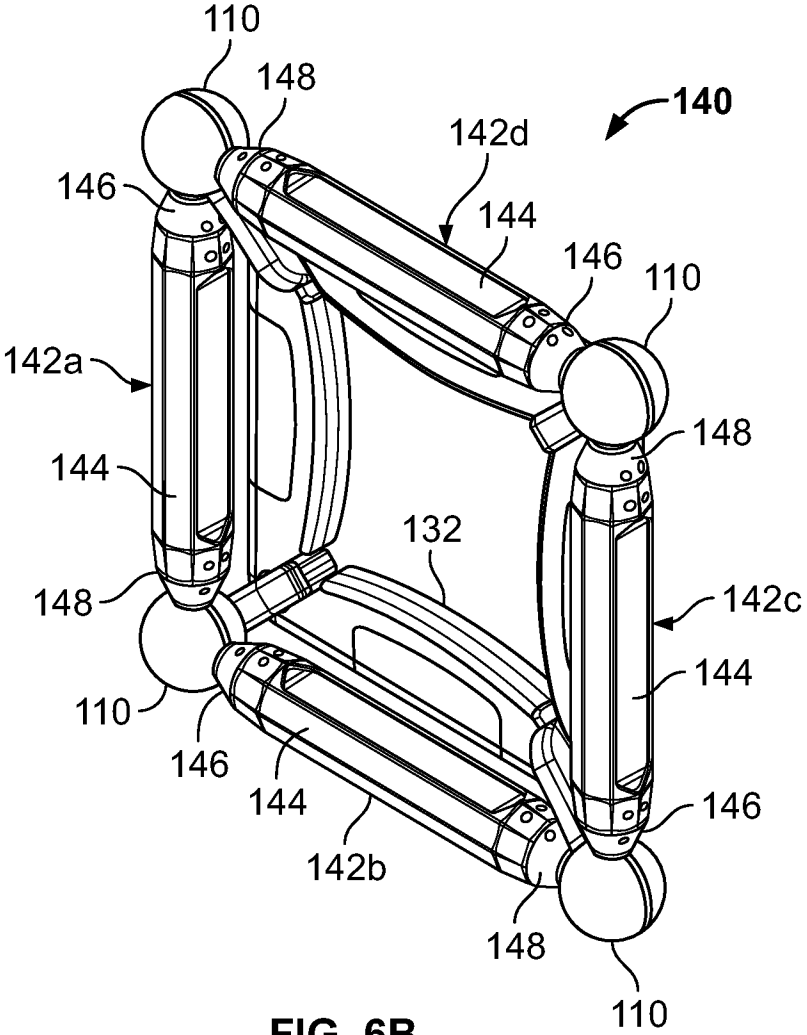
FIG. 6B is a rear perspective view of the combination shown in FIG. 6A.
Figure 6A:
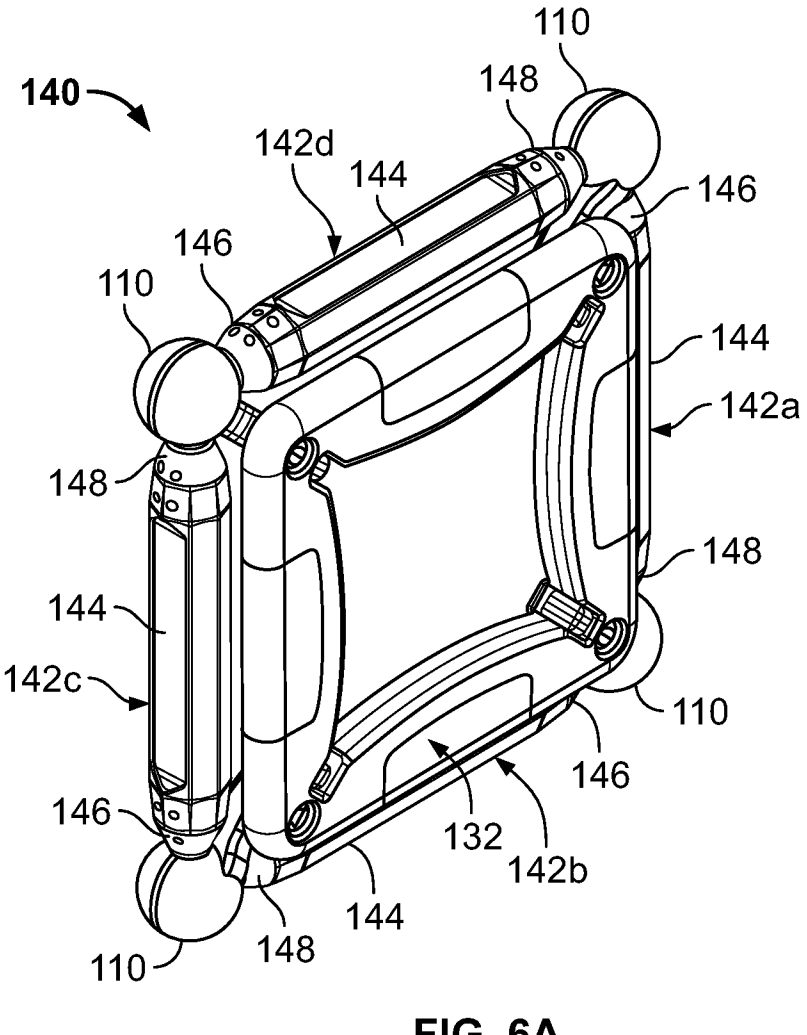
FIG. 6A is a front perspective view of the module/connector assembly of FIGS. 5A-5E shown in combination with four linear magnetic modules.
Figure 6D:
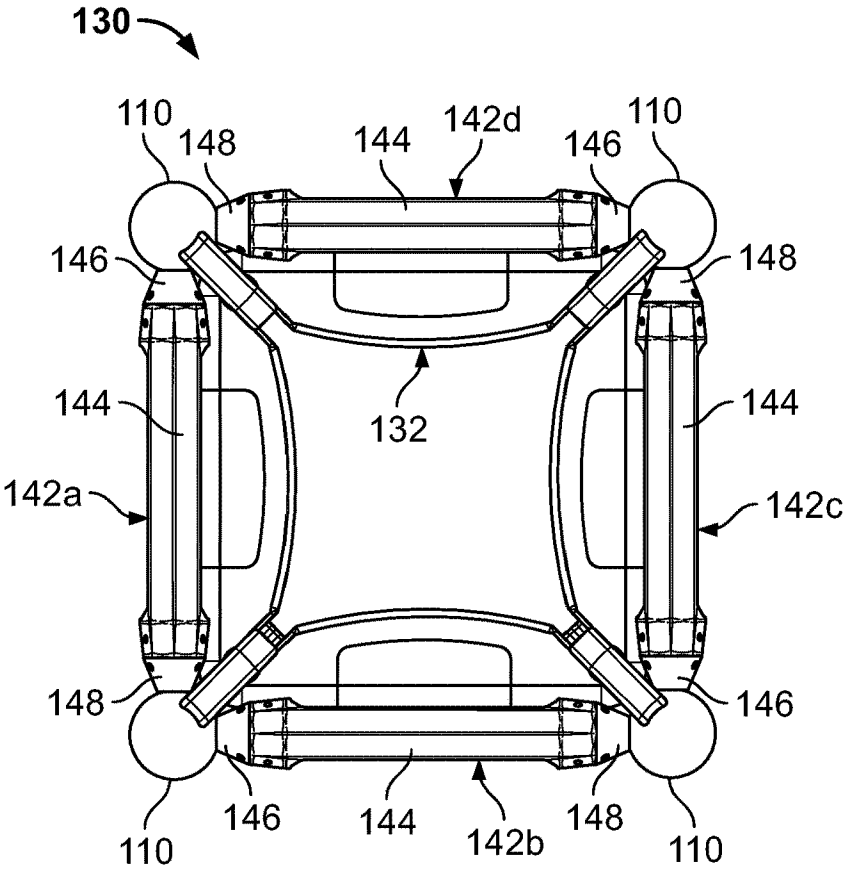
FIG. 6D is a rear elevational view of the combination shown in FIG. 6A.
Figure 6C:
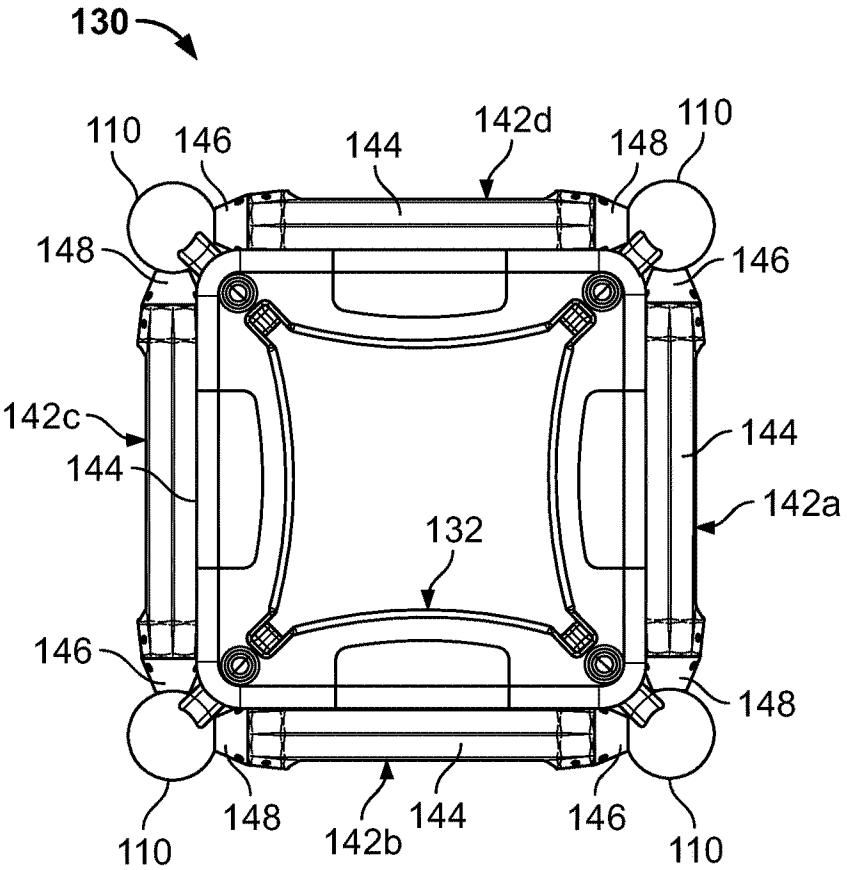
FIG. 6C is a front elevational view of the combination shown in FIG. 6A.
Figure 6E:
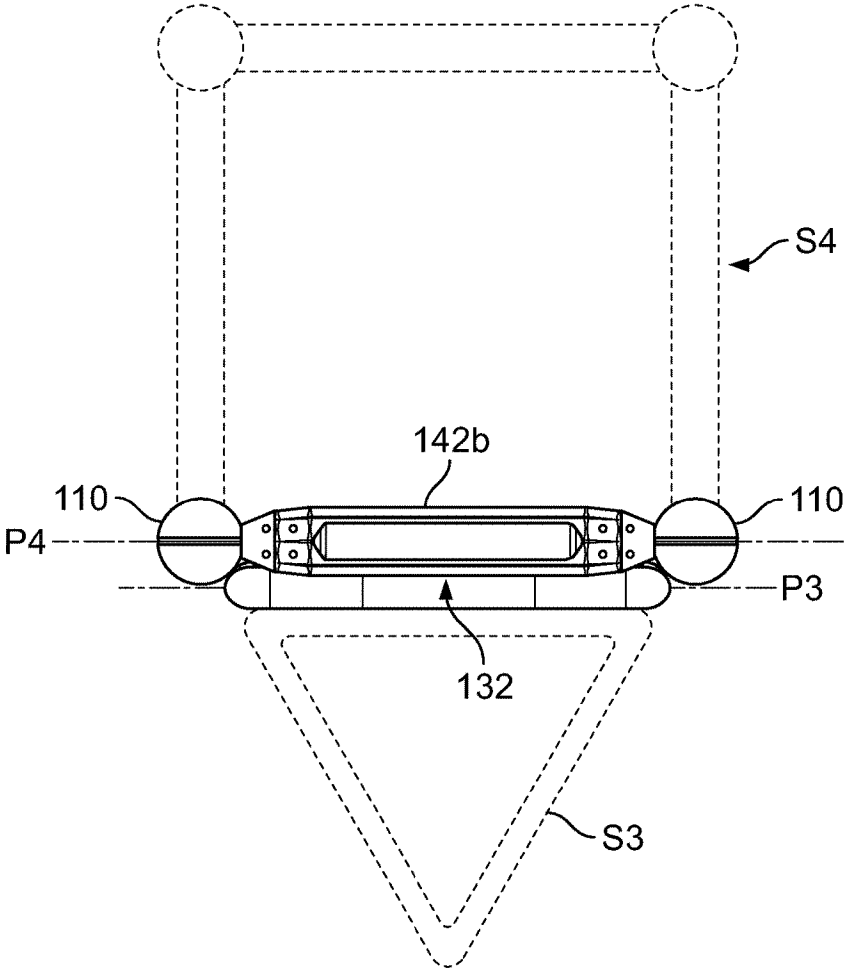
FIG. 6E is a side elevational view of the combination shown in FIG. 6A with optional building components being illustrated schematically and in phantom.

With reference to the assembly 140 illustrated in FIG. 6E, the square frame 132 constitutes a first construction platform, which lies in a plane P3 defined by the square frame 132. Conversely, the connectors 110 cooperate with each other and with the magnetic modules 142*a*-142*d* to define a plane P4 and to form a second construction platform. Referring still to FIG. 6E, the plane P4 is substantially parallel to, but offset from, the plane P3. By providing two construction platforms, the assembly 140 permits a user to build a first subassembly S3 (shown in phantom) off of the first construction platform (i.e., the square frame 132) and a second subassembly S4 (shown in phantom) off of the second construction platform (i.e., the connectors 110 and the magnetic modules 142*a*-142*d*).

By way of example only, and with continued reference to FIG. 6E, other similar or different types of frame-like building elements can be removably connected or attached to the square frame 132 (see, for instance, the triangular frame-like magnetic module shown in phantom in FIG. 6E as subassembly S3), while other similar or different types of magnetic modules can be removably connected or attached to the connectors 110 (see, for instance, the linear magnetic modules and steel balls shown in phantom in FIG. 6E as subassembly S4). In general, but especially when the balls 111 and their enclosures 112 have the spherical, or similar, shape illustrated in, for instance, FIG. 6E, the linear magnetic modules shown in phantom in FIG. 6E can be arranged, or rearranged, at various different angles and orientations relative to the connector 110 that they are magnetically attached to. The assembly 140 illustrated in FIGS. 6A-6E therefore provides multiple platforms upon which a number of diverse and interesting structures can be built.

All examples and conditional language recited herein are intended for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

It will be understood that the embodiments described herein are merely exemplary and that a person skilled in the art may make many variations and modifications without departing from the spirit and scope of the invention. All such variations and modifications are intended to be included within the scope of the invention.

We claim:

1. A connector for a toy construction kit, said connector comprising:

an arm extending in a longitudinal direction from one end of said connector to an opposite end of said connector, said arm including a first arm piece located to one side of said connector and a second arm piece located to an opposite side of said connector and attached to said first arm piece;

mechanical attachment means located at said one end of said connector, said mechanical attachment means including a pair of posts attached to said first arm piece and extending laterally from said one side of said connector in the same lateral direction, one post of said pair of posts having a circular cross-sectional shape and the other post of said pair of posts having a rectangular cross-sectional shape; and magnetically-attractable attachment means located at said opposite end of said connector, said magnetically-attractable attachment means including a spherical steel ball surrounded by a hollow non-magnetic enclosure which extends longitudinally from said opposite end of said connector, said enclosure having a spherical shape and including a first enclosure part attached to said first arm piece and a second enclosure part attached to said second arm piece and to said first enclosure part.

2. The connector of claim 1, wherein said one post and said other post are made of a non-magnetic plastic material.

3. The connector of claim 1, wherein said first enclosure part and a said second enclosure part are made of a non-magnetic plastic material.

4. The connector of claim 1, wherein said first arm piece and said second arm piece are made of a non-magnetic plastic material.

5. The connector of claim 1, wherein said first arm piece is ultrasonically welded to said second arm piece.

6. The connector of claim 1, wherein said first enclosure part is ultrasonically welded to said second enclosure part.

7. A toy construction kit, comprising:

a plurality of connectors, each connector comprising an arm extending in a longitudinal direction from one end of said connector to an opposite end of said connector, said arm including a first arm piece located to one side of said connector and a second arm piece located to an opposite side of said connector and attached to said first arm piece; mechanical attachment means located at said one end of said connector, said mechanical attachment means including a pair of posts attached to said first arm piece and extending laterally from said one side of said connector in the same lateral direction, a first post of said pair of posts having a circular cross-sectional shape and a second post of said pair of posts having a rectangular cross-sectional shape; and magnetically-attractable attachment means located at said opposite end of said connector, said magnetically-attractable attachment means including a spherical steel ball surrounded by a hollow non-magnetic enclosure which extends longitudinally from said opposite end of said connector, said enclosure having a spherical shape and including a first enclosure part attached to said first arm piece and a second enclosure part attached to said second arm piece and to said first enclosure part; and a plurality of modules, each module having at least three legs cooperating to define a closed geometric figure having an open interior and at least three corners, each of said corners having receiving means for receiving said pair of posts of at least one of said plurality of connectors, each of said receiving means including an aperture, which has a circular cross-sectional shape that complements said cross-sectional shape of said first post of said at least one of said plurality of connectors, and a notch located between said aperture and said interior of said geometric figure defined by said legs, said notch having a rectangular cross-sectional shape that complements said cross-sectional shape of said second post of said at least one of said plurality of connectors.

8. The toy construction kit of claim 7, wherein said notch of each of said receiving means opens to said interior of said geometric figure defined by said legs.

9. The toy construction kit of claim 8, wherein each of said legs includes a pair of ends, a cavity located between said pair of ends, and a magnet enclosed within said cavity.

10. The toy construction kit of claim 9, wherein said aperture and said notch of each of said receiving means cooperate to render a corresponding one of said corners of said module frangible in the vicinity of its said aperture and its said notch, whereby the integrity of each of said legs is maintained between its said pair of ends to thereby inhibit the inadvertent removal of its said magnet from its said cavity.

11. A toy construction assembly, comprising:

a module having at least three legs cooperating to define a closed geometric figure having an open interior and at least three corners, each of said corners including an aperture, which has a circular cross-sectional shape, and a notch, which is located between said aperture and said interior of said geometric figure defined by said legs, said notch having a rectangular cross-sectional shape; and a plurality of connectors, one for each of said at least three corners of said geometric figure defined by said legs of said module, each connector of said plurality of connectors including an arm extending in a longitudinal direction from one end of said connector to an opposite end of said connector, said arm including a first arm piece located to one side of said connector and a second arm piece located to an opposite side of said connector and attached to said first arm piece; mechanical attachment means located at said one end of said connector for removably attaching said connector to a corresponding one of said corners of said module, said mechanical attachment means including a pair of posts attached to said first arm piece and extending laterally from said one side of said connector in the same lateral direction, a first post of said pair of posts having a circular cross-sectional shape that complements said cross-sectional shape of said aperture of said corresponding one of said corners of said module, and a second post of said pair of posts having a rectangular cross-sectional shape that complements said cross-sectional shape of said notch of said corresponding one of said corners of said module; and a magnetically-attractable member located at said opposite end of said connector and lying in a second plane which is parallel to and spaced from said first plane, said magnetically-attractable member including a spherical steel ball surrounded by a hollow non-magnetic enclosure which extends longitudinally from said opposite end of said connector, said enclosure having a spherical shape and including a first enclosure part attached to said first arm piece and a second enclosure part attached to said second arm piece and to said first enclosure part.

12. The toy construction assembly of claim 11, wherein said notch of each of said corners opens to said interior of said geometric figure defined by said legs.

13. The toy construction assembly of claim 12, wherein each of said legs includes a pair of ends, a cavity located between said pair of ends, and a magnet enclosed within said cavity.

14. The toy construction assembly of claim 13, wherein said aperture and said notch of each of said corners of said module cooperate to render a corresponding one of said corners of said module frangible in the vicinity of its said aperture and its said notch, whereby the integrity of each of said legs is maintained between its said pair of ends to thereby inhibit the inadvertent removal of its said magnet from its said cavity.

* * * * *